United States Patent [19]

Leopold

[11] 4,332,020

[45] May 25, 1982

[54] ADHESIVE TIME ZONE ADJUSTER

[76] Inventor: Arthur B. Leopold, 129 Sandpiper Key, Harmon Cove, Secaucus, N.J. 07094

[21] Appl. No.: 173,687

[22] Filed: Jul. 30, 1980

[51] Int. Cl.[3] ..... G04B 19/22; G04B 19/04

[52] U.S. Cl. ..... 368/27; 368/228; 368/233

[58] Field of Search ..... 368/21, 27, 223, 228, 368/232, 233, 294, 296, 314, 236, 220, 221

[56] References Cited

U.S. PATENT DOCUMENTS

| | | | |
|---|---|---|---|
| 1,455,482 | 5/1923 | Glenson | 368/223 |
| 2,056,038 | 9/1936 | De Angelis et al. | 368/27 |
| 2,268,239 | 12/1941 | Braaten | 368/27 |
| 2,310,582 | 2/1943 | Jefferson | 368/223 X |
| 3,316,709 | 5/1967 | Edwards | 368/27 |
| 3,382,666 | 5/1968 | Gerry | 368/21 |

*Primary Examiner*—Vit W. Miska

*Attorney, Agent, or Firm*—Hopgood, Calimafde, Kalil, Blaustein & Judlowe

[57] ABSTRACT

An attachment for a watch that locates the time figures of a very simple disc in position to adapt the watch to a different time zone without setting the hands. In one embodiment, the disc is flexible and transparent, except for printed indicia, and is adapted for self-sticking application to the watch crystal. In another embodiment, disc is adjustable for any selected time zone.

4 Claims, 5 Drawing Figures

ADHESIVE TIME ZONE ADJUSTER

BACKGROUND AND SUMMARY OF INVENTION

The watch is used in airplane travel and can be set to show the time at the destination without moving the hands by attaching a disc with hour figures over the crystal of the watch to form a circle of hour numbers that modify the time indicated by the watch and at locations where their use will indicate the time in a different time zone.

One of the advantages of the invention is that it can be made of thin and flexible plastic that is transparent, if desired, and that can be secured to the outside of the crystal of the watch with a pressure-sensitive adhesive so that the numerals printed on the auxiliary disc can be applied conveniently for any time zone and adjusted for different time zones.

The disc can be a throw-away elements of low cost so that they can be advertising items if desired.

For persons that travel often, the disc can be semipermanently secured to the outside of the crystal of the watch and can be rotated to different positions to change the time zone.

Other objects, features and advantages of the invention will appear as the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figure 1:
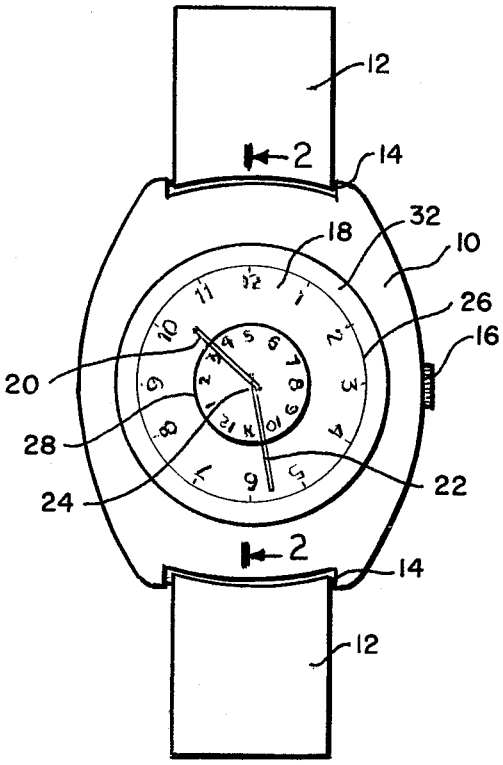
FIG. 1 is an assembly view of a wrist watch connected to a strap and with a plastic disc secured to the outside of the watch crystal with auxiliary hour figures printed on the disc.

FIG. 1 shows a wrist watch 10 with a strap 12 connected to rods 14 at the upper and lower portions of the wrist watch 10. At the end of a stem of the wrist watch, there is a winding element 16 which is used in the conventional manner to wind the watch or to set it.

The wrist watch 10 or other time piece, has a face 18, an hour hand 20 and a minute hand 22 which are connected to shafts 24 at the center of the face 18; a watch crystal 26 is retained by a rim ring 32. An auxiliary watch face 28, which is preferably made of a preprinted thin transparent plastic sheet, is secured to the outside of the crystal 26. The auxiliary watch face is peferably a small plastic disc which may be flexible and transparent and adhered to the outside of the crystal of the wrist watch by a pressure-sensitive adhesive.

Figure 2:
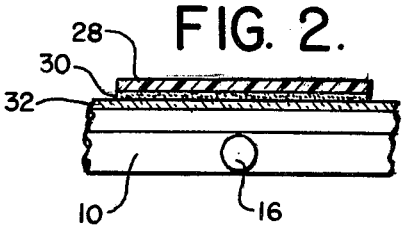
FIG. 2 is a side elevation of the watch shown in FIG. 1 on an enlarged scale and partly in section on the line 2—2 of FIG. 1.

FIG. 2 is a fragmentary elevation of a part of the watch 10 with the auxiliary watch face 28, adhesive 30 and watch crystal 26 shown in section and of exaggerated thickness. The hour numbers on the auxiliary watch face 28 have the same angular spacing as the hour numbers on the watch face 18 and are in radial alignment with the wrist watch (FIG. 1) on the face 18. Using the hands 20 and 22 in conjunction with the figures on the auxiliary watch face 28, the time indicated by the watch is approximately twenty-eight minutes past ten o'clock.

The time indicated by the watch when using the auxiliary watch face 28 is most conveniently determined by angularly positioning the hour number that reflects the added time difference on the auxiliary watch face adjacent the hour indicium "12" on the watch face. The opposite holds true when deducting the time difference. The hour indicium "12" on the auxiliary watch face 28 is positioned opposite the hour indicium on the watch face 28 that reflects the deducted time difference. Thus, if the owner of the watch is taking a plane to another time zone where the time difference is an hour earlier, the auxiliary face 28 is shifted into or applied at the angular position where the "12" on the auxiliary face will be in radial alignment with the "1" on the face 18. If the time-zone difference is in the opposite sense, e.g., an hour later, the auxiliary face 28 is shifted into or reapplied at the position where the "12" on the auxiliary face is in radial alignment with the "11" on the face 18.

FIG. 2 is a diagrammatic view with the watch shown in elevation and the watch crystal 26 and the auxiliary face 28 shown in section.

Figure 3:
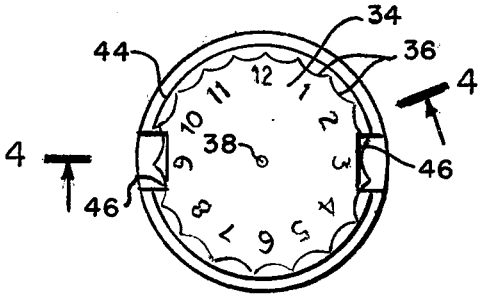
FIG. 3 is a front view of a modified form of the invention which has the disc adjustable for different time zones.
Figure 4:
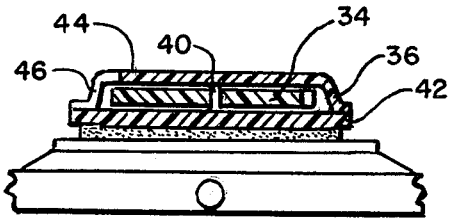
FIG. 4 is a fragmentary sectional view taken on the line 4—4 of FIG. 3 and showing the disc that carries the hour figures mounted for rotation about the center axis.

FIGS. 3 and 4 show a modified construction in which the thicknesses are exaggerated for clearer illustration. An auxiliary watch face 34 has a scalloped circumference with individual scallops indicated by the reference character 36. There is a center opening 38 through which a stud 40 (FIG. 4) extends as an axle on which the disc 34 can rotate. The axle 40 extends upward from an underlying disc 42 which is secured to the crystal of the watch face by an adhesive, preferably a pressure sensitive adhesive. A plastic cover 44 of transparent material exposes the axial disc 34 (FIG. 3) to view.

The cover 44 is secured to the top surface of the disc 42. The cover 44 extends downwardly and has a peripheral edge portion which is secured to the disc 42. There are cutouts 46 in opposite sides of the cover 44, two cutouts 46 being shown in FIG. 3 and one cutout 46 being shown in FIG. 4 which is a section on the line 4—4 of FIG. 3.

In order to rotate the auxiliary disc 34 about the axle 40, a finger can be inserted into either of the openings 46 and into contact with one of the scallops 36 so as to rotate the auxiliary disc 34 to bring any desired figure on the disc to the position to indicate a different time zone as explained in connection with FIG. 1. The plastic elements such as the auxiliary disc 34, the lower disc 42 (FIG. 4) and the cover 44 have their thickness exaggerated in FIG. 4 in order to make the construction clearer, but actually the elements are thin and flexible so that each one rests upon the one below it and this provides enough friction to hold the auxiliary disc 34 in contact with the disc 42 and the cover 44. The auxiliary disc 34 will, therefore, remain in any position to which it is moved by applying the fingers to the respective scallops 36.

Figure 5:
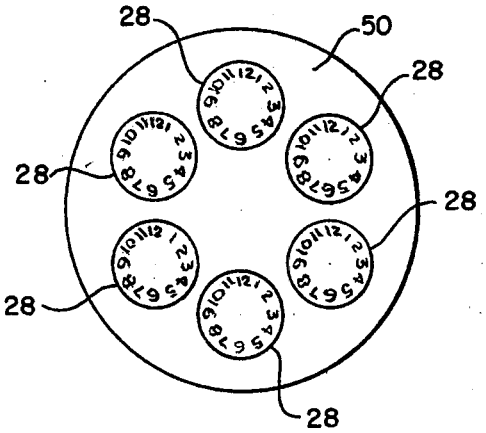
FIG. 5 depicts a plastic sheet having a number of hour-indicating discs of the type used in FIG. 1, the sheet being so devised that a single one of the discs can be selectively removed when needed, along tear lines at the disc perimeter.

FIG. 5 shows a thin plastic sheet 50 which is preferably transparent and which has six auxiliary watch faces 28 printed on the front face of the plastic sheet 50. Each of these auxiliary watch faces 28 is made with the plastic 50 of reduced thickness around the periphery of each auxiliary watch face 28 so that the watch face can be punched out of the plastic 50 to obtain a perfect circle for the respective auxiliary watch faces 28. The back of the plastic element 50 is preferably coated with pressure sensitive adhesive; alternatively, the adhesive may be applied to the back of each of the auxiliary watch faces 28 to be activated at the time that the face 28 is to be applied to the crystal of a watch.

The preferred embodiments of the invention have been illustrated and described, but changes and modifications can be made and some features can be used in different combinations without departing from the invention as defined in the claims.

What is claimed is:

1. Apparatus for changing the time zone of a timepiece including in combination a face with hour figures spaced around the circumferential area of the face, hands that rotate about the center of the face, a crystal that covers the face beyond the hands and an auxiliary disc that fits over a portion of the area of the crystal and with numerals indicating the hours of the day, said auxiliary disc having adhesive on its rearward surface for securing the face to the crystal of the timepiece with numerals on the auxiliary disc correlated with the hour figures around the circumferential area of the face so as to correspond to a time zone that is different from the hour figures spaced around the circumferential area of the face of the timepiece, and adhesive on the auxiliary disc on the side that is attached to the crystal of the timepiece; said auxiliary disc consisting of three layers, the first layer being secured to the timepiece and the third layer being secured to the first layer around at least a portion of the periphery of said third and first layers, and the second layer being sandwiched between the third and first layers and of less surface area than the third and first layers so that no part of the second layer extends between the portions of the first and second layers that contact with one another, and the second layer being rotatable between the first and second layers to change the location of hour figures on the second layer and to change the relative position of the second layer with respect to the hour numbers thereon and with respect to the hour numbers on the face of the timepiece.

2. The apparatus described in claim 1 characterized by the third layer having open spaces through which portions of the second layer are exposed through said openings so that a person using the timepiece can reach the second layer and rotate the second layer with respect to the hour numbers on the face of the timepiece.

3. The apparatus described in claim 2 characterized by the periphery of the circumference of the second layer having gaps in the circumference of the second layer, and openings through the third layer through which a person can reach the gaps in the circumference of the second layer for rotating the second layer with respect to the first and third layers, the clearance between the first and third layers having sufficient friction to hold the second layer in any set position to which the second layer is moved by digital rotation of the second layer with respect to the face of the timepiece to which the first and third layers are secured.

4. The apparatus described in claim 3 characterized by the first layer and the third layer having faces that confront one another with the second layer between them and with the first and third layers each of larger area than the second layer and with the third layer sloping downward toward the first layer, and a stud extending through the center of the second layer and about which the second layer rotates as on an axle.

* * * * *